US008950911B2

(12) United States Patent
Fryzek et al.

(10) Patent No.: US 8,950,911 B2
(45) Date of Patent: Feb. 10, 2015

(54) SELF-ADJUSTING LIGHT-EMITTING DIODE OPTICAL SYSTEM

(75) Inventors: Aaron P. Fryzek, Wheaton, IL (US); John Whittenhall, Roselle, IL (US)

(73) Assignee: Juno Manufacturing, LLC, Des Plaines, IL (US)

( * ) Notice: Subject to any disclaimer, the term of this patent is extended or adjusted under 35 U.S.C. 154(b) by 226 days.

(21) Appl. No.: 13/437,638

(22) Filed: Apr. 2, 2012

(65) Prior Publication Data

US 2013/0258677 A1 Oct. 3, 2013

(51) Int. Cl.
*F21S 8/08* (2006.01)

(52) U.S. Cl.
USPC ..... 362/418; 362/440

(58) Field of Classification Search
CPC ..... F21V 21/042; F21V 21/049; F21V 21/03; F21V 21/04; F21S 8/04; F21S 8/026; F21S 8/028; F21S 8/02
USPC ..... 362/384, 418, 429, 430, 440, 444, 445, 362/372, 364, 365, 366
See application file for complete search history.

(56) References Cited

U.S. PATENT DOCUMENTS

| | | | | |
|---|---|---|---|---|
| 4,118,765 | A * | 10/1978 | Atsuchi | 362/465 |
| 6,350,043 | B1 * | 2/2002 | Gloisten | 362/287 |
| 7,775,683 | B2 * | 8/2010 | Ziemkowski et al. | 362/259 |
| 8,070,328 | B1 * | 12/2011 | Knoble et al. | 362/311.02 |
| 2003/0031028 | A1 * | 2/2003 | Murray et al. | 362/545 |
| 2007/0041220 | A1 * | 2/2007 | Lynch | 362/646 |
| 2011/0032716 | A1 * | 2/2011 | Burton | 362/460 |
| 2011/0317411 | A1 * | 12/2011 | Lee | 362/235 |
| 2013/0063938 | A1 * | 3/2013 | Ma et al. | 362/235 |

OTHER PUBLICATIONS

Element-Lighting, Installation Instructions for Round or Square Type IC Adjustable Housing with LED Lamp for Flangeless Trims, 2008 (8 pages).
Element-Lighting, Product Brochure for Element 3" LED Adjustable Downlight, 2011 (4 pages).

* cited by examiner

*Primary Examiner* — Julie Bannan
(74) *Attorney, Agent, or Firm* — Locke Lord LLP

(57) ABSTRACT

A mounting assembly for a lighting fixture includes a fixture shield and an optic housing coupled at least in part to the fixture shield and having a light-emitting surface. The assembly further includes a heat sink movably coupled to the fixture shield in an initial low position, the heat sink being self-adjusting to one or more high positions relative to the fixture shield in direct response to displacement caused by one or more objects contained within the optic housing.

17 Claims, 5 Drawing Sheets

SELF-ADJUSTING LIGHT-EMITTING DIODE OPTICAL SYSTEM

FIELD OF THE INVENTION

This invention is directed generally to lighting systems, and, more particularly, to a self-adjusting mounting system with minimum gap between a light-emitting surface and a finishing trim.

BACKGROUND OF THE INVENTION

A standard lighting fixture, such as a recessed lighting fixture, is mounted in a ceiling and includes a mounting assembly having a light-emitting diode light source ("LED"). The LED is mounted to a heat sink, which is in a fixed position relative to a fixture shield of the mounting assembly. The LED emits a light beam transmitted through an optic (which is mounted in an optic housing) into a finishing trim. The face of the optic is generally representative of a light-emitting surface. However, if one or more optic accessories are interposed between the optic housing and the finishing trim, the light-emitting surface is considered to be the face of the last optic accessory through which the light beam passes prior to entering the finishing trim.

Typically, the optic accessories are stacked between the finishing trim and the optic housing to alter properties of the light beam, including beam size, beam shape, and beam color. In response to changing the number, size, and/or shape of the optic accessories, a gap formed between the optic housing and the finishing trim is increased. For example, as optic accessories are added, the overall general thickness of the optic accessories increases, which, in turn, causes the gap to increase. The larger the number of accessories, the larger the gap. Similarly, the thicker the accessories, the larger the gap.

The increased gap effectively causes the light-emitting surface to be displaced farther away from the ceiling inwards into the room, resulting in a light beam having a changed appearance in size and/or shape. Thus, one problem with current fixtures is that, depending on how many and which optic accessories are used, an increased gap between the optic housing and the finishing trim results in an inconsistent appearance of the light beam. Another problem with current fixtures is that the increased gap allows light to "spill" outside the finishing trim, causing a reduction in light output and fixture efficiency.

SUMMARY OF THE INVENTION

In an implementation of the present invention, a mounting assembly for a lighting fixture has a LED mounted to a heat sink that is self-adjustable relative to a fixture shield. The mounting assembly includes one or more optics (including optic accessories) in which a light-emitting surface has a constant position, relative to the fixture shield, regardless of changes made to the number and/or size of the optics. For example, as optics are added to the mounting assembly, the heat sink (and mounted LED) automatically adjusts along a plurality of spring-loaded fasteners to compensate for the thickness of the added optics. The automatic adjustment, however, does not cause a change in position of the light-emitting surface.

One advantage of the mounting assembly is directed to allowing an optimum and automatic position adjustment of the light-emitting surface to be achieved based on self-adjustment features. The optimum position adjustment maximizes usable light output and minimizes wasted light under varying conditions, resulting in improvements in performance and efficiency. As such, based on the improvements in efficiency, less power is required to achieve a desired light output. Furthermore, the lower power level allows smaller, simpler heat sinks to be used because the LED does not have to be driven as hard to obtain the same light output as traditional products.

Another advantage of the mounting assembly is directed to consistent positioning of the light-emitting surface regardless of the number of and/or type of optic accessories being used. Yet another advantage of the mounting assembly is directed to offering flexibility in optical choices, design, and/or size, (e.g., increasing the possible number of optical accessories being used) without sacrificing desired positioning of the light-emitting surface.

In another implementation of the present invention, a mounting assembly for a lighting fixture includes a fixture shield and an optic housing coupled at least in part to the fixture shield and having a light-emitting surface. The assembly further includes a heat sink movably coupled to the fixture shield in an initial low position, the heat sink being self-adjusting to one or more high positions relative to the fixture shield in direct response to displacement caused by one or more objects contained within the optic housing.

In another alternative implementation of the present invention, a mounting assembly for a recessed fixture includes a heat sink coupled to a fixture shield. The heat sink is movable between a plurality of positions, including a low position, in which the heat sink is nearest to the fixture shield, and at least one high position in which the heat sink is farther from the fixture shield than in the low position. A total internal reflection lens, having a lens face, is fixedly coupled to the heat sink. The lens face is at a first distance from the fixture shield in the low position and at a second distance from the fixture shield in the at least one high position, the first distance being greater than the second distance. Movement of the total internal reflection lens causes automatic movement of the heat sink relative to the fixture shield. The mounting assembly further includes at least one spring for compressing the heat sink toward the fixture shield in each of the plurality of positions.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Figure 1:
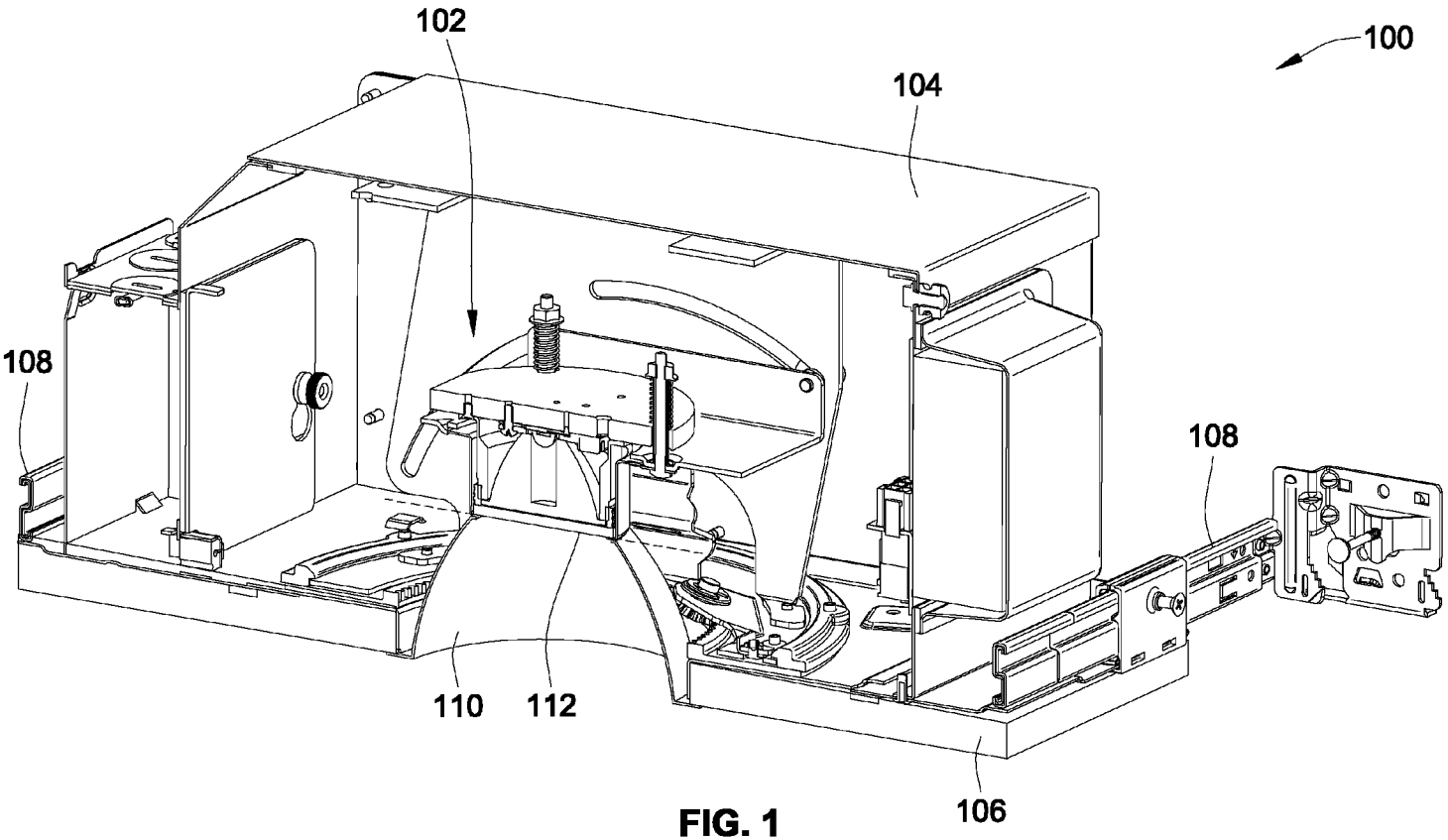
FIG. 1 is a cross-sectional perspective illustrating a recessed light fixture assembly.

Referring to FIG. 1, a lighting assembly 100 includes a mounting assembly 102 installed in a ceiling-mounted recessed lighting fixture 104. The lighting fixture 104 is concealed from view by a ceiling 106, and is secured in position on a top side of the ceiling 106 via a plurality of adjustable bars 108, which are typically mounted to structural joists. In another example, the lighting fixture 104 can be mounted in a location that is not concealed by the ceiling and can have a decorative appearance, such as a track lighting fixture.

A finishing trim 110 is inserted through and mounted flush with the ceiling 106. A top surface of the finishing trim 110 is near a light-emitting surface 112, which, as described in more detail below, remains in the same position regardless of displacements of components in the mounting assembly 102.

Figure 2:
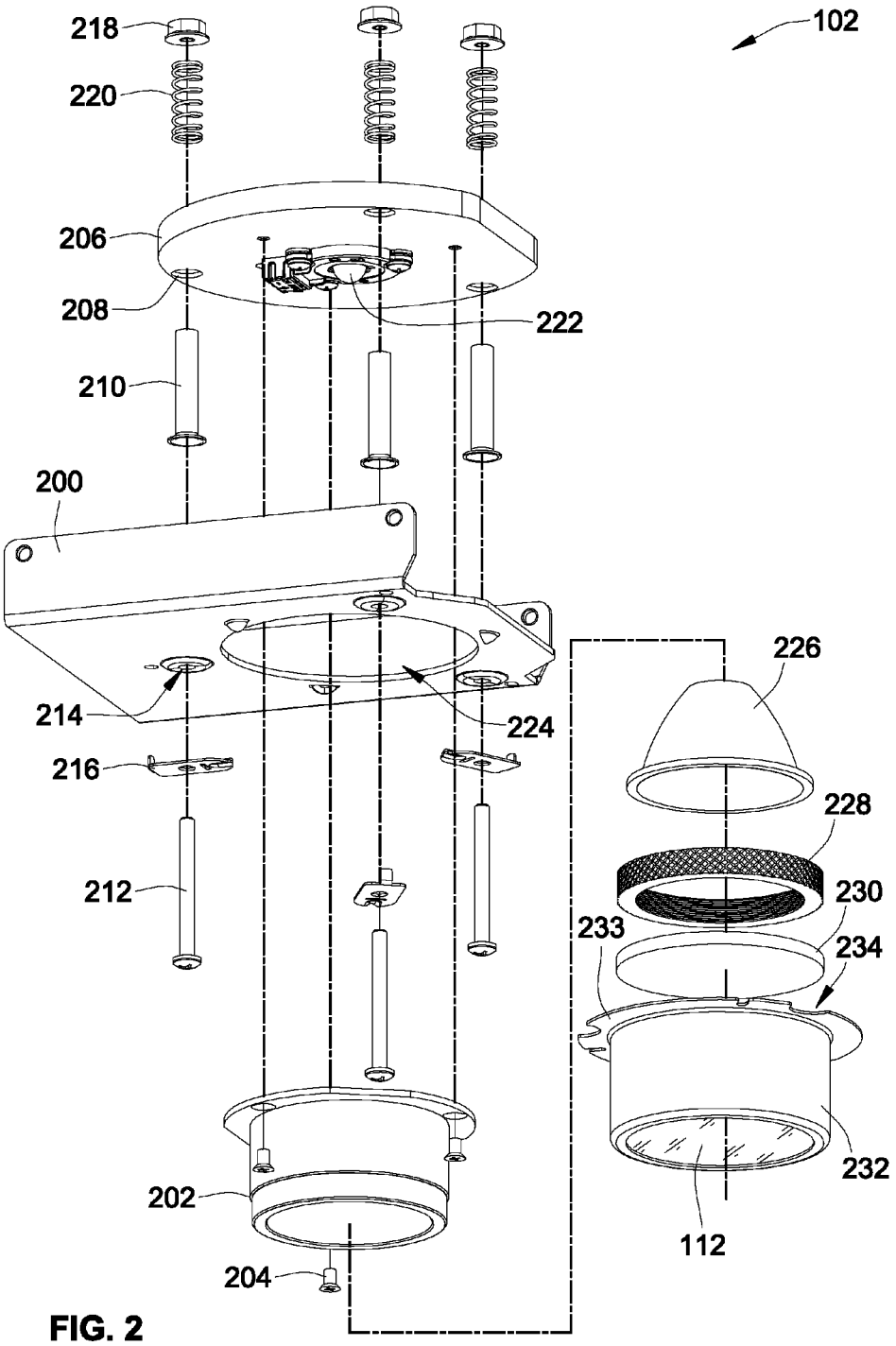
FIG. 2 is an exploded view of a mounting assembly for a recessed light fixture.

Referring to FIG. 2, the mounting assembly 102 includes a fixture shield 200 mounted within the lighting fixture 104. An inner optic housing 202 is securely fastened to a bottom surface of the heat sink 206 via a plurality of short housing screws 204. The inner optic housing 202 passes through a large central hole 224 of the fixture shield 200.

A heat sink 206 is movably coupled on a top surface of the fixture shield 200, opposite to the inner optic housing 202. The heat sink 206 has a plurality of guide-receiving holes 208 for receiving corresponding guides 210. The guides 210 have internal through-holes for receiving corresponding long housing screws 212, which are inserted through corresponding housing mounting holes 214 and secure in position respective ones of a plurality of optic holder springs 216. The housing mounting holes 214 are positioned in a triangular orientation on the fixture shield 200. The long housing screws 212 are fastened to corresponding nut flanges 218, with corresponding compression springs 220 being interposed between the nut flanges 218 and a top surface of the heat sink 206. The compression springs 220 are cylindrical helixes in form, each of which having an internal hole, or passage, for receiving the guides 210 (in which the long housing screws 212 are inserted).

Figure 4:
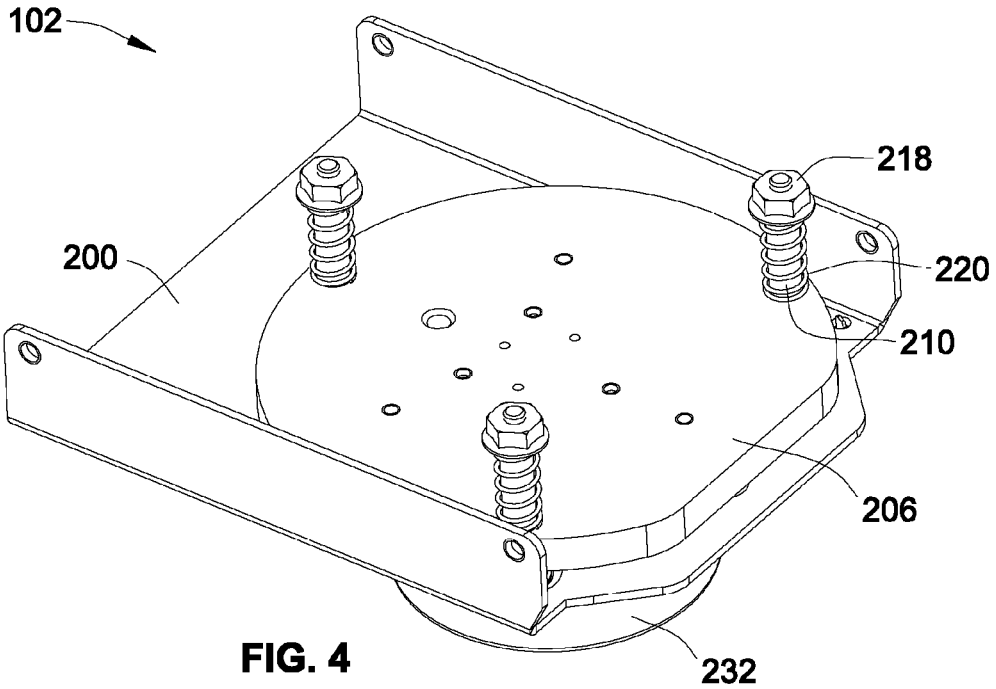
FIG. 4 is a top perspective view of the mounting assembly of FIG. 2.
Figure 6:
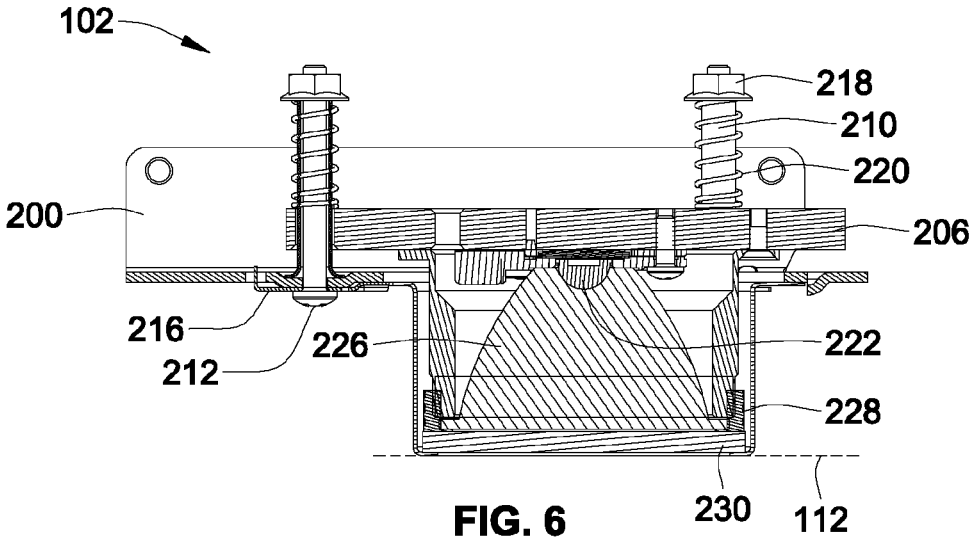
FIG. 6 is a cross-sectional side view of the mounting assembly of FIG. 2.

The combination of the long housing screws 212, the guides 210, the compression springs 220, and the nut flanges 218 form spring-loaded fasteners for applying a compression force that adjustably presses the heat sink 206 toward the fixture shield 200 (as shown in FIGS. 4 and 6). The length of the long housing screws 212 and the guides is such that the compression springs 220 can vary in length over a predetermined range (as discussed in more detail below) in response to displacement of the heat sink 206.

The heat sink 206 is adapted to receive in a central position of its bottom surface a replaceable light-emitting diode ("LED") 222. The LED 222 emits light in the shape of a beam that is outputted through a large central hole in the inner optic housing 202 through which a light-control object 226 is received. The light-control object 226 is attached to the inner optic housing 202 via a small bezel 228. The light-control object 226 can be, for example, a total internal reflection lens or reflector intended to alter the size or shape of the light beam emitted by the LED 222. Based on the geometry of the total internal reflection lens, a desired size and/or shape of the light beam can be achieved.

One or more glass lenses 230 are stacked as optional optic accessories adjacent to the light-control object 226 and within an outer optic housing 232. Other optic accessories include, for example, a color filter, a dichroic lens, a diffuse spread lens, a linear spread lens, a frensel lens, and a prismatic spread lens. The optic accessories are intended to change properties of the light beam emitted by the LED 222, including the size, shape, and color of the light beam.

Figure 3:
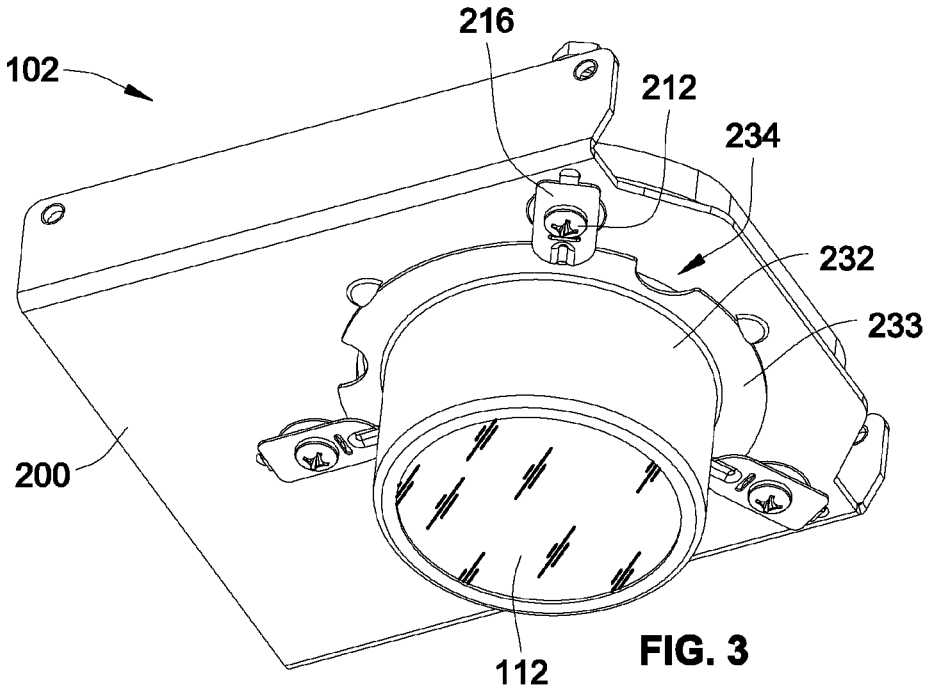
FIG. 3 is a bottom perspective view of the mounting assembly of FIG. 2.
Figure 5:
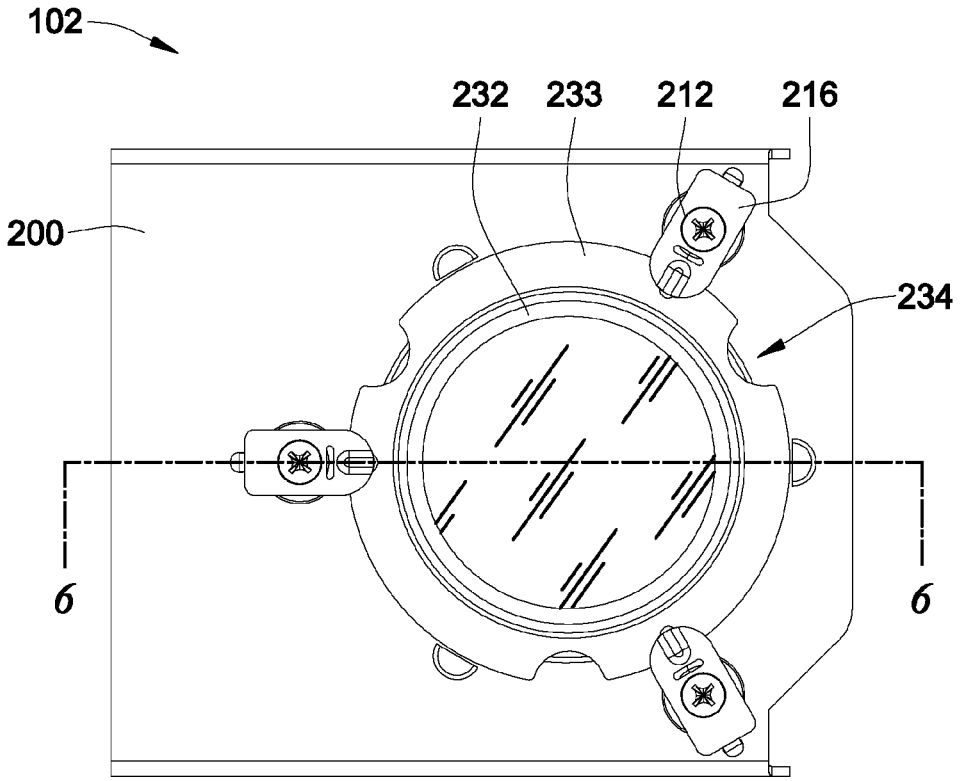
FIG. 5 is a bottom view of the mounting assembly of FIG. 2.

The outer optic housing 232 has a retaining lip 233 with a plurality of mounting notches 234. To attach the outer optic housing 232 to the fixture shield 200, the retaining lip 233 is pressed against the bottom surface of the fixture shield 200 with the mounting notches 234 initially aligned, correspondingly, over the optic holder springs 216. Then, the outer optic housing 232 is rotated into a secured position such that the retaining lip 233 is secured in position between the bottom surface of the fixture shield 200 and the optic holder springs 216 (as shown in FIGS. 3 and 5). To remove the outer optic housing 232 from the fixture shield 200, the outer optic housing 232 is rotated in an opposite direction to disengage the retaining lip 233 from the optic holder springs 216 and, then, pulled down.

The light-emitting surface 112 is the surface through which the light beam emitted by the LED 222 is transmitted from the outer optic housing 232, i.e., the face of the outer optic housing 232. If no optic accessories are inserted between the outer optic housing 232 and the light-control object 226, the face of the light-control object 226 is adjacent to the face of the outer optic housing 232. In this scenario, the light-emitting surface 112 can be represented by either the face of the outer optic housing 232 or the face of the light-control object 226. If optic accessories are inserted, the face of the last optic accessory through which the light beam passes, prior to entering the finishing trim 110, is adjacent to the face of the outer optic housing 232. In this scenario, the light-emitting surface 112 can be represented by either the face of the outer optic housing 232 or the face of the last optic accessory.

The light-emitting surface 112 remains constant relative to the fixture shield 200, regardless of any self-adjustment of the heat sink 206 relative to the fixture shield 200. The relationship between the self-adjustment of the heat sink 206 and the stationary position of the light-emitting surface 112 is discussed in more detail below in reference to FIGS. 7-9.

Figure 7:
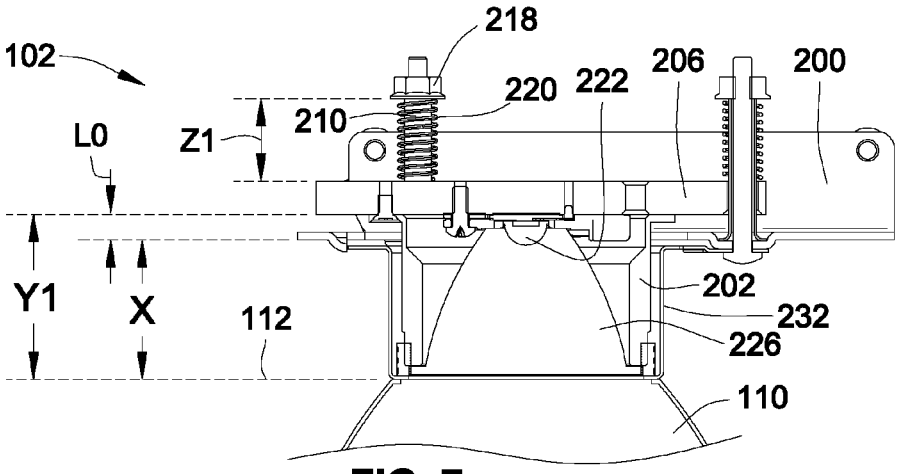
FIG. 7 is a side cutout view illustrating a mounting assembly in a low position without any optic accessories.
Figure 8:
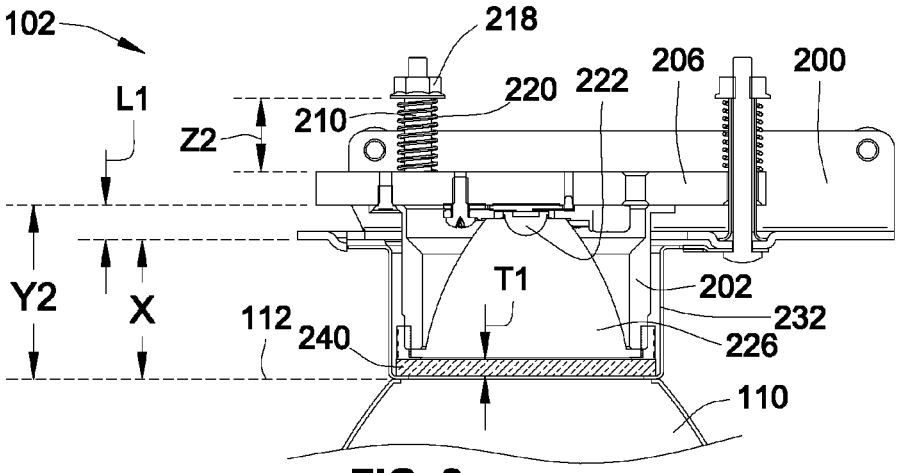
FIG. 8 illustrates the mounting assembly of FIG. 7 in a first raised position with one optic accessory.
Figure 9:
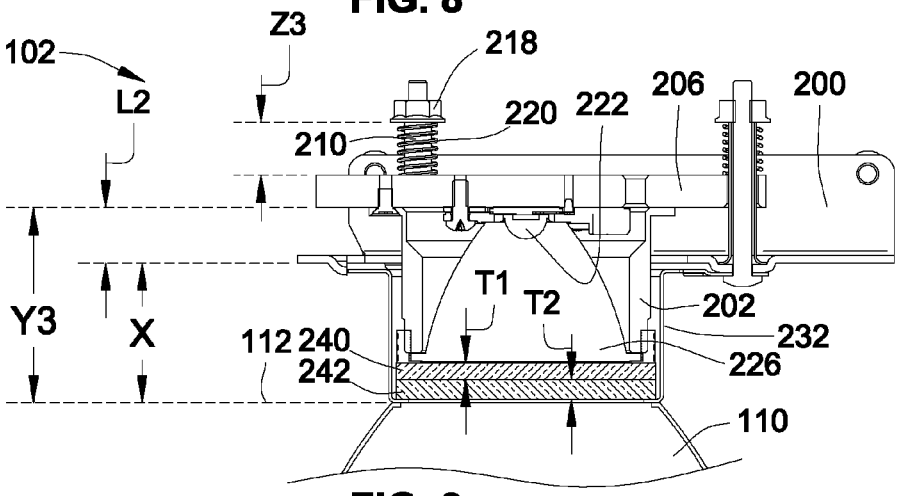
FIG. 9 illustrates the mounting assembly of FIG. 7 in a second raised position with two stacked optic accessories.

Referring generally to FIGS. 7-9, the self-adjustment features of the mounting assembly 102 are directed to automatically adjusting the heat sink 206 from an initial low position (shown in FIG. 7) to a number of high positions (shown in FIGS. 8 and 9) relative to the fixture shield 200. The automatic adjustment is in direct response to displacement (or interference) caused by optic accessories 240, 242 being added within the outer optic housing 232.

Referring more specifically to FIG. 7, the mounting assembly 102 is in the initial low position in which the face of the light-control object 226 is in contact with the outer optic housing 232 along the light-emitting surface 112. In this position, the light-emitting surface 112 is at a distance X from the fixture shield 200, the heat sink 206 is at a distance Y1 from the light-emitting surface 112 and a distance L0 from the fixture shield 200, and the compression spring 220 has an initial extended length Z1 between the nut flange 218 and the top surface of the heat sink 206. In the low position, there are no optic accessories inserted between the face of the light-control object 226 and the outer optic housing 232.

Referring now specifically to FIG. 8, the mounting assembly 102 is in a first high position in which a first optic accessory 240 has been inserted between the face of the light-control object 226 and the outer optic housing 232. Based on the insertion of the first optic accessory 240, which has a thickness T1, the light-control object 226 has been displaced upwards. The movement of the light-control object 226, which rests against the inner optic housing 202, causes the displacement of the inner optic housing 202, which, in turn, causes the displacement of the heat sink 206.

In the first high position (with a single optic accessory 240 of thickness T1), the light-emitting surface 112 remains constant at the distance X from the fixture shield 200. However, the heat sink 206 is now at a distance Y2 (Y2>Y1) from the light-emitting surface 112 and at a distance L1 from the fixture shield 200 (L1=T1+L0). Additionally, the compression spring 220 now has a first compressed length Z2 between the nut flange 218 and the top surface of the heat sink 206 (Z2=Z1−T1), the length of displacement of the compression spring 220 being equal to the thickness T1 of the optic accessory 240.

Thus, the position of the light-emitting surface 112 remains unchanged regardless of the insertion of the first optic accessory 240. Also, the compression spring 220 exerts a larger compression force (in response to the displacement equal to Z1−Z2) than in the low position.

Referring now to FIG. 9, the mounting assembly 102 is in a second high position in which a second optic accessory 242 has been inserted between the first optic accessory 240 and the outer optic housing 232. Based on the insertion of the second optic accessory 242, which has a thickness T2, the light-control object 226 has been displaced further upwards relative to the first high position.

In the second high position (with two optic accessories 240, 242 of thickness T1+T2), the light-emitting surface 112 remains constant at the distance X from the fixture shield 200. However, the heat sink 206 is now at a distance Y3 (Y3>Y2) from the light-emitting surface 112 and at a distance L2 from the fixture shield 200 (L2=T1+T2+L0). Additionally, the compression spring 220 now has a second compressed length Z3 between the nut flange 218 and the top surface of the heat sink 206 (Z3=Z1−T1−T2), the length of displacement of the compression spring 220 being equal to the overall thickness (T1+T2) of the two optic accessories 240, 242.

Thus, again, the position of the light-emitting surface 112 remains unchanged regardless of the insertion of the additional second optic accessory 242. Also, the compression spring 220 exerts a larger compression force (in response to the displacement equal to Z1−Z3) than in the first high position.

In an alternative embodiment, instead of or in addition to stacking one or more of the optic accessories 240, 242, the light-control object 226 is replaced with another light-control object having a different size and/or shape than the light-control object 226. Nevertheless, the effect on the self-adjustment of the mounting assembly 102 remains the same because the self-adjustment features can accommodate the differently sized/shaped light-control object similarly to accommodating stacking of optic accessories.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A mounting assembly for a lighting fixture, the assembly comprising:

a fixture shield;

an optic housing coupled at least in part to the fixture shield and having a light-emitting surface; and a heat sink movably coupled to the fixture shield in an initial low position, the heat sink being self-adjusting to one or more high positions relative to the fixture shield in direct response to displacement caused by one or more objects contained within the optic housing, the heat sink having a bottom surface facing toward the fixture shield and a top surface opposite the bottom surface; and a plurality of spring-loaded fasteners for coupling the heat sink to the fixture shield, each of the spring-loaded fasteners including a compression spring which applies a force against the top surface of the heat sink to adjustably press the heat sink toward the fixture shield.

2. The mounting assembly of claim 1, wherein at least one of the plurality of spring-loaded fasteners includes a screw inserted through the compression spring.

3. The mounting assembly of claim 1, wherein the plurality of spring-loaded fasteners includes three spring-loaded fasteners arranged in a triangular orientation on the heat sink.

4. The mounting assembly of claim 1, wherein the one or more objects include at least one of (i) a light-control object and (b) one or more optic accessories stacked between the light-control object and the light-emitting surface.

5. The mounting assembly of claim 1, wherein the one or more objects include at least one of a bezel, a color filter, a dichroic lens, a diffuse spread lens, a linear spread lens, a frensel lens, and a prismatic spread lens.

6. The mounting assembly of claim 1, further comprising a finishing trim having a top surface positioned near the light-emitting surface of the optic housing, the top surface remaining constant relative to the light-emitting surface regardless of displacement of the heat sink between the initial low position and the one or more high positions.

7. The mounting assembly of claim 1, wherein the optic housing includes an inner optic housing and an outer optic housing, the outer optic housing being removably locked to the fixture shield via a plurality of optic holder springs, the inner optic housing being fixedly mounted to and movable with the heat sink.

8. The mounting assembly of claim 1, further comprising a light-emitting diode mounted in a central position on a bottom surface of the heat sink.

9. A mounting assembly for a recessed fixture, the assembly comprising:

a fixture shield;

a heat sink coupled to the fixture shield and movable between a plurality of positions, the plurality of positions including a low position in which the heat sink is nearest to the fixture shield, the plurality of positions including at least one high position in which the heat sink is farther from the fixture shield than in the low position;

a total internal reflection lens fixedly coupled to the heat sink and having a lens face at a first distance from the fixture shield in the low position and at a second distance from the fixture shield in the at least one high position, the first distance being greater than the second distance, movement of the total internal reflection lens causing automatic movement of the heat sink relative to the fixture shield;

at least one spring for compressing the heat sink toward the fixture shield in each of the plurality of positions, the at least one spring being a compression spring having an internal hole;

a screw being positioned within the internal hole of the compression spring; and a cylindrical guide having an internal hole, the screw being positioned within the internal hole of the cylindrical guide, the cylindrical guide being positioned within the internal hole of the compression spring.

10. The mounting assembly of claim 9, further comprising an optic housing mounted to a bottom surface of the fixture shield and having a light-emitting surface, the light-emitting surface being at a constant distance from the fixture shield for each of the plurality of positions of the heat sink.

11. The mounting assembly of claim 10, wherein the optic housing has an inner optic housing and an outer optic housing, the inner optic housing being fixedly mounted to the heat sink, the total internal reflection lens being positioned in direct contact with the inner optic housing and within the outer optic housing, the outer optic housing being removably mounted to the fixture shield.

12. The mounting assembly of claim 10, further comprising one or more optic accessories positioned in the optic housing between the light-emitting surface and the lens face, insertion of the one or more optic accessories causing automatic movement of the heat sink in response to movement of the lens face from the first distance to the second distance, which includes the low position to the at least one high position.

13. The mounting assembly of claim 12, wherein the one or more optic accessories include at least two stacked optic accessories.

14. The mounting assembly of claim 10, further comprising a finishing trim positioned at a constant distance from the light-emitting surface for each of the plurality of positions of the heat sink.

15. The mounting assembly of claim 1, wherein the heat sink includes a plurality of holes extending from the top surface to the bottom surface, each spring-loaded fastener having a portion thereof extending through a corresponding one of the heat sink holes.

16. The mounting assembly of claim 15, wherein each spring-loaded fastener further includes a screw connected on one end to the fixture shield and on another end with a flange, the spring of each spring-loaded fastener being arranged on a respective screw between the flange and the top surface of the heat sink.

17. The mounting assembly of claim 16, wherein each compression spring of the spring-loaded fasteners is in contact with the top surface of the heat sink.

* * * * *